US009382746B2

(12) United States Patent
Inatama

(10) Patent No.: US 9,382,746 B2
(45) Date of Patent: Jul. 5, 2016

(54) DOOR CONTROL DEVICE

(71) Applicant: FUJI ELECTRIC CO., LTD., Kawasaki-shi (JP)

(72) Inventor: Shigeki Inatama, Yokkaichi (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/469,949

(22) Filed: Aug. 27, 2014

(65) Prior Publication Data

US 2015/0059247 A1 Mar. 5, 2015

(30) Foreign Application Priority Data

Sep. 4, 2013 (JP) ..... 2013-183469

(51) Int. Cl.
*E05F 15/632* (2015.01)
*E05F 15/40* (2015.01)
*E05D 15/10* (2006.01)

(52) U.S. Cl.
CPC ..... *E05F 15/632* (2015.01); *E05F 15/40* (2015.01); *E05D 15/1002* (2013.01); *E05Y 2201/22* (2013.01); *E05Y 2400/354* (2013.01); *E05Y 2400/45* (2013.01); *E05Y 2400/52* (2013.01); *E05Y 2400/54* (2013.01); *E05Y 2900/51* (2013.01)

(58) Field of Classification Search
CPC ..... E05F 15/40; E05F 15/42; E05F 15/44; E05Y 2900/51
USPC ..... 49/26–28, 116, 118; 318/266, 466
See application file for complete search history.

(56) References Cited

U.S. PATENT DOCUMENTS

| | | | | | |
|---|---|---|---|---|---|
| 3,745,705 | A | * | 7/1973 | Reddy | 49/139 |
| 3,916,567 | A | * | 11/1975 | Daugirdas | 49/28 |
| 4,035,956 | A | * | 7/1977 | Newson | 49/280 |
| 4,051,336 | A | * | 9/1977 | Miller | 200/61.43 |
| 4,133,365 | A | * | 1/1979 | Schleicher | 160/118 |
| 4,142,326 | A | * | 3/1979 | Schmitz | 49/118 |
| 4,413,568 | A | * | 11/1983 | Huon de Kermadec | 104/20 |
| 4,476,678 | A | * | 10/1984 | Hall | 60/404 |
| 4,490,941 | A | * | 1/1985 | Mamach | 49/28 |
| 4,491,917 | A | * | 1/1985 | Higgins et al. | 701/49 |
| 4,621,452 | A | * | 11/1986 | Deeg | 49/28 |
| 4,750,591 | A | * | 6/1988 | Coste et al. | 187/391 |
| 4,831,509 | A | * | 5/1989 | Jones et al. | 700/90 |
| 4,882,876 | A | * | 11/1989 | Daugirdas | 49/141 |
| 4,901,474 | A | * | 2/1990 | Bayard et al. | 49/26 |
| 4,981,084 | A | * | 1/1991 | Templeton et al. | 105/341 |

(Continued)

FOREIGN PATENT DOCUMENTS

JP 2003-020858 A 1/2003

*Primary Examiner* — Katherine Mitchell
*Assistant Examiner* — Justin Rephann
(74) *Attorney, Agent, or Firm* — Rabin & Berdo, P.C.

(57) ABSTRACT

A door control device is disclosed. In the door control device, after operation of "Full Close" in one status has been detected, obstruction occurs in a door close detection switch ON/OFF detection portion so that one event "Dcsm=OFF", e.g. a signal (Dcsm=OFF) indicating OFF detected by the door close detection switch ON/OFF detection portion is obtained. On this occasion, operation of "ReClose" in another status is executed so that drive toward a close direction is continued by a door close control portion through a reclose command portion until another event "Dcsm=ON", e.g. a signal (Dcsm=ON) indicating ON detected by the door close detection switch ON/OFF detection portion is obtained.

10 Claims, 7 Drawing Sheets

(56) References Cited

U.S. PATENT DOCUMENTS

| | | | | | |
|---|---|---|---|---|---|
| 5,119,739 | A * | 6/1992 | Templeton et al. | 105/341 |
| 5,280,754 | A * | 1/1994 | Flanagan et al. | 105/341 |
| 5,341,598 | A * | 8/1994 | Reddy | 49/362 |
| 5,838,126 | A * | 11/1998 | Llerena | 318/286 |
| 5,841,083 | A * | 11/1998 | Schonauer et al. | 187/316 |
| 5,996,281 | A * | 12/1999 | Takano et al. | 49/26 |
| 6,134,838 | A * | 10/2000 | Reddy | 49/362 |
| 6,525,659 | B2 * | 2/2003 | Jaffe et al. | 340/545.6 |
| 6,626,268 | B1 * | 9/2003 | Masuda et al. | 187/317 |
| 6,631,788 | B2 * | 10/2003 | Shikai et al. | 187/316 |
| 6,962,239 | B2 * | 11/2005 | Shikai et al. | 187/316 |
| 7,603,813 | B2 * | 10/2009 | Hackl | 49/506 |
| 8,205,387 | B2 * | 6/2012 | Ranaudo et al. | 49/141 |
| 2002/0144467 | A1 * | 10/2002 | Teich | 49/506 |
| 2010/0050526 | A1 * | 3/2010 | Ozaki | 49/28 |
| 2013/0125468 | A1 * | 5/2013 | El Fassi et al. | 49/26 |
| 2013/0340346 | A1 * | 12/2013 | Ueda et al. | 49/280 |

* cited by examiner

DOOR CONTROL DEVICE

CROSS REFERENCE TO RELATED APPLICATION

The entire disclosure of the inventor's corresponding Japanese patent application, Serial No. JP PA 2013-183469, filed Sep. 4, 2013, is hereby incorporated by reference.

BACKGROUND OF THE INVENTION

1. Field of the Invention

The present invention relates to a door control device in which a door drive portion is constituted by an electric motor and a door is controlled to be opened and closed by driving force of the door drive portion.

2. Description of the Background Art

FIGS. 5A and 5B are views showing the configuration of a train door apparatus in which a door is driven by driving force generated by an electric motor. FIG. 5A shows the configuration of the train door apparatus 1 in a door open state. FIG. 5B shows the configuration of the train door apparatus 1 in a door full close state. FIG. 6 is a view for describing a general door open/close sequence which has been known in the background art.

As shown in FIGS. 5A and 5B, upon reception of an open request command/close request command from a now-shown train operating system, a door control device 2 controls a door drive portion built in the door control device 2 to achieve open/close control on the door apparatus in accordance with the door open/close sequence which has been known in the background art as shown in FIG. 6.

The train door driven by the door drive portion built in the door control device 2 is characterized by the existence of a lock mechanism 5 shown in FIG. 5A. In addition, when the door is locked by the lock mechanism 5 in the door full close state of FIG. 5B, the door (a left door panel 6 and a right door panel 7) can be kept in the full close state even if the driving force of the door drive portion (for example, a door drive motor) built in the door control device 2 is shut off. A position detector such as an encoder is built in the door control device 2. The state of the door is detected from an operation signal of the position detector, operation signals of door close detection switches 4 and operation information of a lock detection sensor (not shown) of the lock mechanism 5. In addition, the door close detection switches 4 detect a door close state when both a push rod 3 provided in an upper portion of the left door panel 6 and a push rod 3 provided in an upper portion of the right door panel 7 touch and push the door close detection switches 4 respectively. In addition, the lock detection sensor detects lock when the lock mechanism 5 operates to lock the door (the left door panel 6 and the right door panel 7).

As shown in FIG. 6, "Full Close" in Status (S1) is detected and determined on the condition of operation signals (Dcsm=ON) of the door close detection switches 4 in Event (E4a) "Dcsm=ON" shown in a center portion of FIG. 6 when the door is operated up to a full close position. In addition, "Open" in Status (S2) shown in a center upper portion of FIG. 6 performs an open operation in response to Event (E1) "Open Request Command" shown in an upper left portion of FIG. 6. In this manner, a continuous door open and close operation is achieved as an operation in the door open/close sequence which has been known in the background art. Incidentally, although not shown, Event (E1) "Open Request Command" is valid even during operation of "Close" in Status (S4) shown in a center portion of FIG. 6. In addition, Event (E3) "Close Request Command" shown in a center right portion of FIG. 6 is valid even during operation of "Open" in Status (S2) shown in the center upper portion of FIG. 6 and has a function to follow a command from the middle of the operation.

Event (E5a) "Obstruction Detected" shown in a center lower portion of FIG. 6 detects a state in which the door cannot be closed, for example, when a foreign substance is caught in the door. In this case, operation of "Recycle Open & Close" in Status (S5) in a center lower portion of FIG. 6 is performed. The operation of "Recycle Open & Close" in Status (S5) means a function of opening the door up to a full open state and resuming a close operation after a lapse of a predetermined time in order to remove the caught substance. It has been known by those skilled in the art that this function has been broadly used for train doors. Incidentally, various "Obstruction" detection methods may be used for the detection condition of Event (E5a) "Obstruction Detected". For example, "Obstruction" may be detected when the door close detection switches 4 cannot detect a door close state though the position detector detects a state where the door position has been fixed to a position other than the full close position or a state where the door speed has been decreased, or when an overload state where a current flowing into the electric motor (motor) used for the door drive portion has increased beyond a predetermined value has been detected. However, the invention will make no mention about which "Obstruction" detection method to use.

JP-A-2003-020858 discloses a method for opening/closing a motor-operated switch. That is, JP-A-2003-020858 describes the method which includes: a first step of setting a timer in accordance with a movement distance toward a close direction or an open direction and starting an electric motor in the close direction or the open direction when a close switch or an open switch is turned ON in open/close control in a power window in a car etc.; and a second step of stopping the electric motor when pulses from a pulse generation unit are counted and reach a predetermined count value after the first step or when the time counted by the timer is up before the pulses reach the predetermined count value. Thus, abnormality of the motor-operated switch can be detected in an early stage and the overload state of the electric motor can be avoided. In addition, in the above description, the electric motor is rotated reversely when the time counted by the timer is up during operation of the electric motor.

It is believed that even the background-art door open/close sequence shown in FIG. 6 can operate the door apparatus normally. However, take into consideration whether sufficient safety is secured or not as a train door apparatus. In this case, for example, when obstruction occurs in the door close detection switches 4, Event (E4b) "Dcsm=OFF" is detected and the operation of "Close" in Status (S4) is executed again, as shown in FIG. 6. In this case, due to the obstruction in the door close detection switches 4, operation signals "Dcsm=ON" of the door close detection switches 4 indicated in Event (E4a) "Dcsm=ON" are not generated but the operation of "Recycle Open & Close" in Status (S5) is performed. As described above, under normal circumstances, the operation of "Recycle Open & Close" in Status (S5) is an operation to open the door up to a full open state and resume a close operation after a lapse of a predetermined time in order to remove a caught substance. Accordingly, it can be easily imagined that the operation of "Recycle Open & Close" in Status (S5) may be effective during the operation of "Close" when the train is stopped at a station etc. and the door side is on the platform side, but the operation of "Recycle Open & Close" can cause a serious accident when obstruction in the door close detection switches 4 occurs on the door side opposite to the platform side or during running of the train.

In addition, in the aforementioned method for the open/close control of the power window in JP-A-2003-020858, the motor-operated switch is suspended based on the time limit set by the timer as a safety measure during trouble of the sensor. Therefore, when this method is applied to a train door, the train may run with the door open. Accordingly, there is a problem that the method cannot be used for taking a sufficient safety measure.

SUMMARY OF THE INVENTION

Therefore, an object of the invention is to provide a door control device which can perform a safe operation even when obstruction or abnormality occurs in a door close detection switch, a lock mechanism, etc.

In order to achieve the object, according to a first configuration of the invention, there is provided a door control device for making control to open/close a door through a door drive portion, wherein: the door control device at least includes:

a door open/close control portion which has an open command portion giving an open command to the door drive portion, a close command portion giving a close command to the door drive portion, a reclose command portion giving a reclose command to the door drive portion, and a recycle open and close command portion giving a recycle open and close command to the door drive portion;

a door close control portion which drives the door drive portion in response to the close command or the reclose command;

an open and close operation recycle control portion which drives the door drive portion recyclically in response to the recycle open and close command;

a door open control portion which drives the door drive portion in response to the open command;

a door close detection switch ON/OFF detection portion which detects a full close state of the door based on ON/OFF of a switch; and a lock mechanism operation/non-operation detection portion which detects operation/non-operation of a lock mechanism locking the door in a close position; and in response to OFF of the switch detected by the door close detection switch ON/OFF detection portion and/or non-operation of the lock mechanism detected by the lock mechanism operation/non-operation detection portion after full close of the door has been detected based on ON of the switch detected by the door close detection switch ON/OFF detection portion, a close operation of the door is continuously performed by the door close control portion until ON of the switch is detected by the door close detection switch ON/OFF detection portion.

In addition, according to a second configuration of the invention, there is provided a door control device according to the first configuration, wherein:

when the fact that the close operation of the door has been performed by the door close control portion a plurality of times recyclically within a predetermined time is detected, an obstruction signal of the lock mechanism is outputted.

In addition, according to a third configuration of the invention, there is provided a door control device according to the first configuration, wherein:

when ON of the switch is not detected by the door close detection switch ON/OFF detection portion in spite of the close operation of the door performed continuously for a predetermined time by the door close control portion, an obstruction signal of the door close detection switch is outputted.

In addition, according to a fourth configuration of the invention, there is provided a door control device according to any one of the first through third configurations, wherein:

an open command operation is made valid when the close operation of the door is continuously performed by the door close control portion due to OFF of the switch detected by the door close detection switch ON/OFF detection portion and/or non-operation of the lock mechanism detected by the lock mechanism operation/non-operation detection portion after full close of the door has been detected based on ON of the switch detected by the door close detection switch ON/OFF detection portion.

According to the invention, it is possible to achieve a safe train door apparatus which does not affect a door open/close operation at normal time but can prevent an unsafe door open operation at obstruction time of the lock mechanism, the door close detection switch etc.

In addition, the invention can be achieved only by improvement of software in the door control device. Accordingly, function improvement can be attained without causing any increase of the cost spent for members, assembling, etc., in comparison with the case where the door control device is constituted by hardware.

DETAILED DESCRIPTION OF THE INVENTION

Embodiments of the invention will be described below in detail.

Embodiment 1

Figure 1:
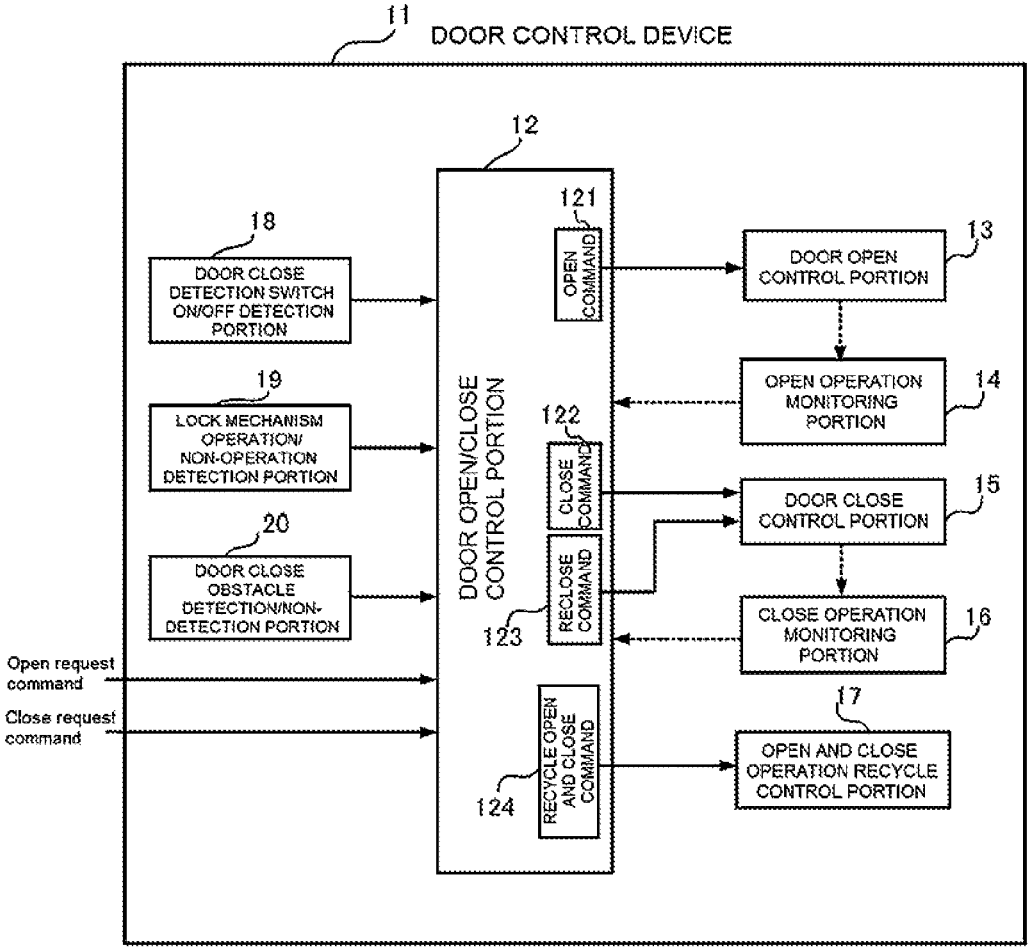
FIG. 1 is a block diagram showing the configuration of a door control device according to Embodiment 1 of the invention.
Figure 5A:
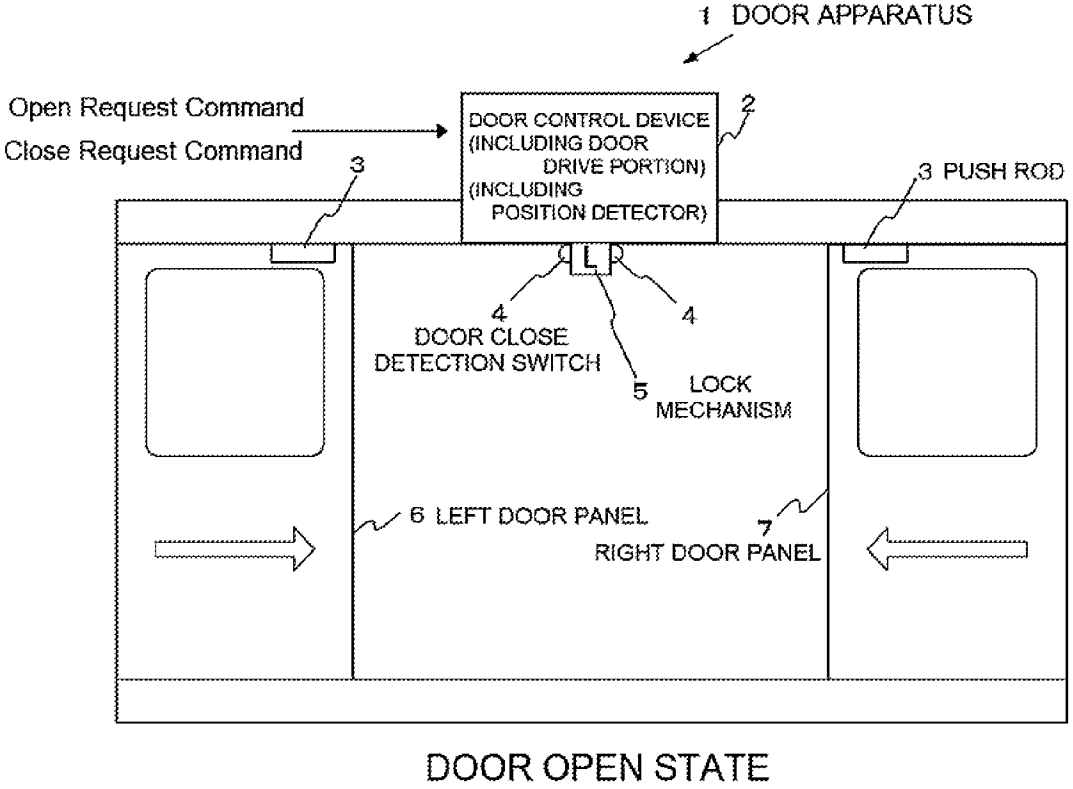
FIGS. 5A and 5B are views showing the configuration of a train door apparatus in which a door is electrically driven to be opened/closed.
Figure 5B:
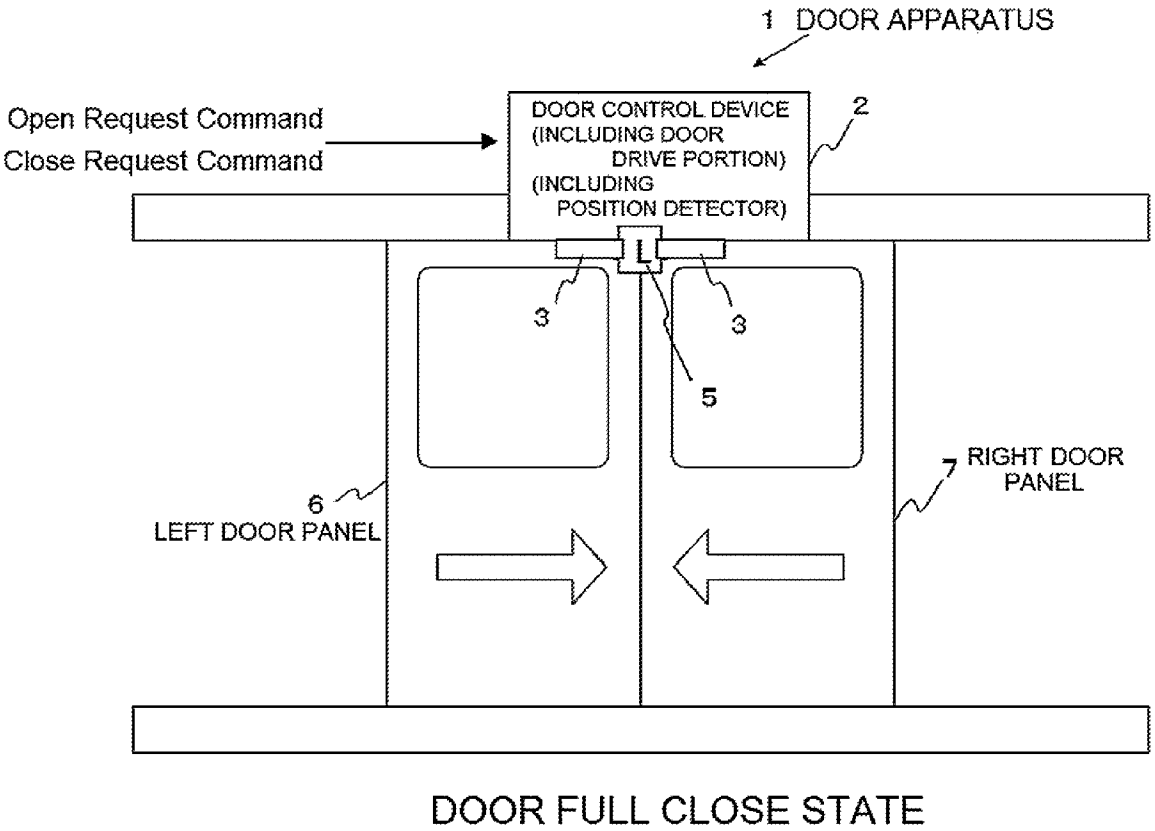

FIG. 1 is a block diagram showing the configuration of a door control device according to Embodiment 1 of the invention. The door control device shown in FIG. 1 is applied to the train door apparatus 1 shown in FIGS. 5A and 5B.

In FIG. 1, a door control device 11 includes a door open/close control portion 12, a door open control portion 13, an open operation monitoring portion 14, a door close control portion 15, a close operation monitoring portion 16, an open and close operation recycle control portion 17, a door close detection switch ON/OFF detection portion 18, a lock mechanism operation/non-operation detection portion 19, and a door close obstacle detection/non-detection portion 20.

The door open/close control portion 12 imports, as inputs to itself, signals from the aforementioned door close detection switch ON/OFF detection portion 18, the aforementioned lock mechanism operation/non-operation detection portion 19 and the aforementioned door close obstacle detection/non-detection portion 20, an open request command/close request command from a not-shown operating system and signals from the aforementioned open operation monitoring portion 14 and the aforementioned close operation monitoring portion 16. At the same time, the door open/close control portion 12 outputs, from itself, an open command to the door open control portion 13 through an open command portion 121, a close command and a reclose command to the door close control portion 15 through a close command portion 122 and a reclose command portion 123, and a recycle open and close command to the open and close operation recycle control portion 17 through a recycle open and close command portion 124, respectively.

Here, when, for example, a foreign substance is caught in a door, Event (E5a) "Obstruction Detected" detects a state in which the door cannot be closed. In this case, the open and close operation recycle control portion 17 performs operation of "Recycle Open & Close" in Status (S5) to open the door once up to a full open state and then resume a close operation after a lapse of a predetermined time in order to remove the caught substance.

Incidentally, a control process performed by the door open/close control portion 12 in the door control device 11 can be implemented by a computer executing a program which is described with commands for executing the control process.

Figure 2:
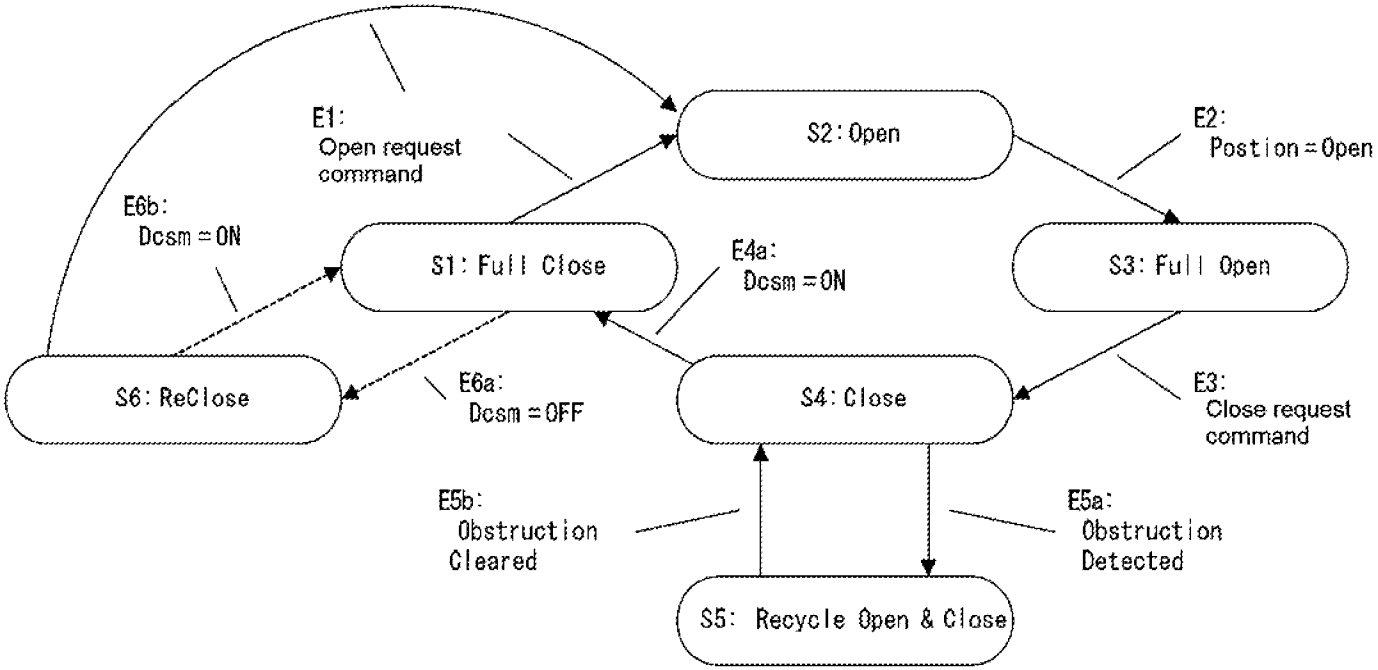
FIG. 2 is a view showing a door open/close sequence according to Embodiment 1 of the invention.
Figure 6:
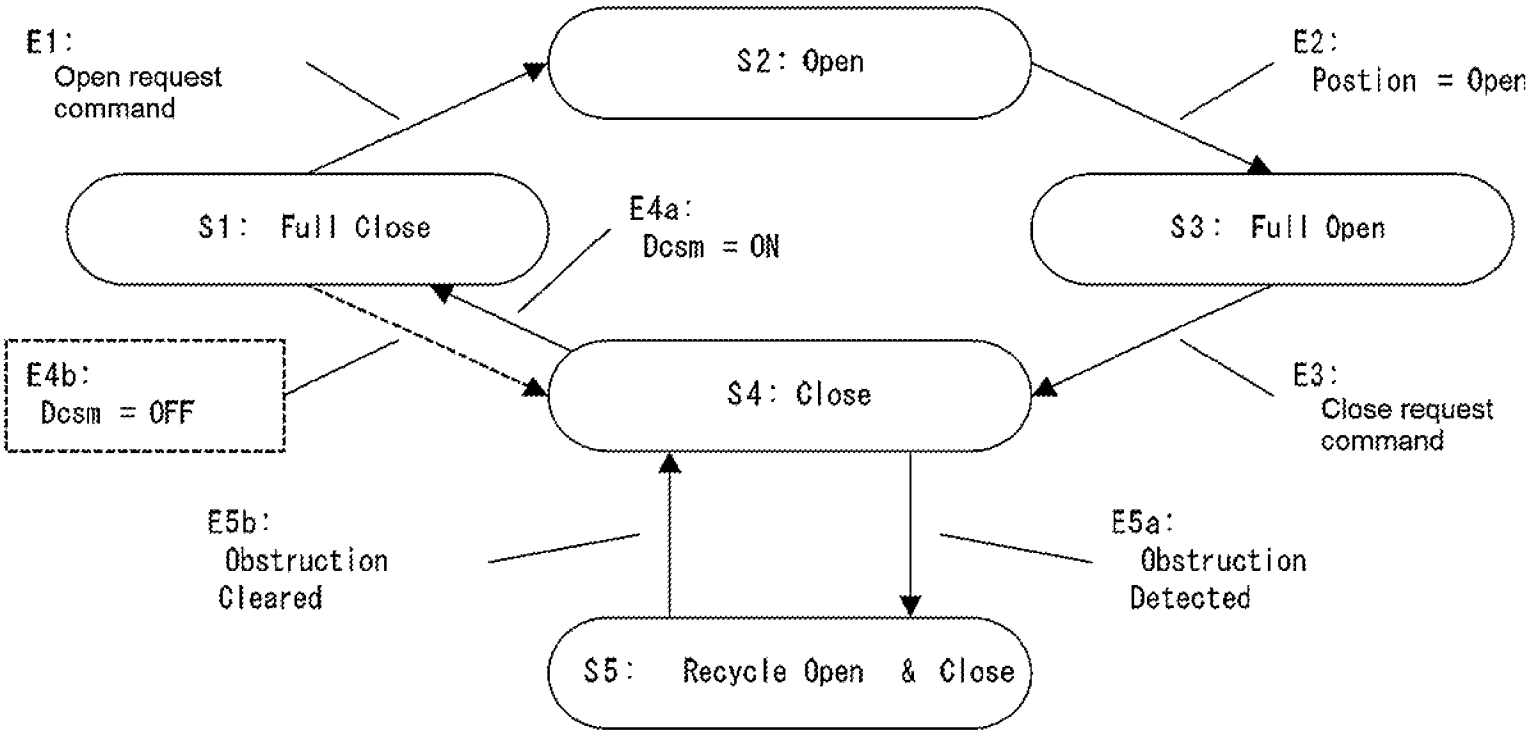
FIG. 6 PRIOR ART
FIG. 6 is a view for describing a general door open/close sequence which has been known in the background art.

FIG. 2 is a view showing a door open/close sequence according to Embodiment 1 of the invention, in which a safe door open/close operation can be performed even when obstruction occurs in the door close detection switches 4 or the lock mechanism 5 (see FIGS. 5A and 5B) in the background-art door open/close sequence shown in FIG. 6.

In the door open/close sequence shown in FIG. 2, after the operation of "Full Close" in Status (S1) is detected, obstruction occurs in the door close detection switch ON/OFF detection portion 18 so that Event (E6a) "Dcsm=OFF", i.e. a signal indicating OFF detected by the door close detection switch ON/OFF detection portion 18 is obtained. On this occasion, the operation of "ReClose" in Status (S6) is executed so that driving toward a close direction is continued by the door close control portion 15 through the reclose command portion 123 until Event (E6b) "Dcsm=ON", i.e. a signal (Dcsm=ON) indicating ON detected by the door close detection switch ON/OFF detection portion 18 is obtained.

Incidentally, in the operation of "Full Close" in Status (S1), it is determined that the door has been operated up to a full close position, based on operation signals (Dcsm=ON) of the door close detection switches 4 in Event (E4a). That is, after a close command is given to the door close control portion 15 from the close command portion 122 of the door open/close control portion 12 shown in FIG. 1, the door close/open control portion 12 confirms that the door has reached a full close state based on an input of ON from the aforementioned door close detection switch ON/OFF detection portion 18. Incidentally, in the operation of "Full Open" in Status (S3), it is determined that the door has been operated up to a full open position, based on Event (E2) "Position=Open". That is, after an open command is given to the door open control portion 13 from the open command portion 121 of the door open/close control portion 12 shown in FIG. 1, the door open/close control portion 12 confirms that the door has reached a full open state based on a position detection signal from the position detector (not shown) such as an encoder provided in the door control device 2.

In the case where the door cannot be kept at the full close position due to obstruction of the door close detection switch ON/OFF detection portion 18 (also including obstruction of the door close detection switches 4 per se) or obstruction of the lock mechanism operation/non-operation detection portion 19 (also including obstruction of the lock mechanism per se), the operation of "ReClose" in Status (S6) continuously gives a close command to the door close control portion 15 to shift the door to the "Full Close" state. Thus, safety can be secured even when unexpected obstruction occurs.

Even in the case where the operation of "ReClose" in Status (S6) is continued due to the obstruction of the door close detection switch ON/OFF detection portion 18 or the lock mechanism operation/non-operation detection portion 19, the operation of Event (E1) "Open Request Command" is made valid in the same manner as in the background-art door open/close sequence shown in FIG. 6. Thus, a situation that the malfunctioned door cannot be opened can be prevented from occurring. When the operation of "ReClose" in Status (S6) is added, any harmful effect can be prevented from affecting a door open/close operation under normal circumstances.

Thus, according to the door open/close sequence according to the embodiment, it is possible to improve the situation of occurrence of such an extremely unexpected operation that Event (E4b) "Dcsm=OFF" falls into Event (E5a) "Obstruction Detected" in the background-art door open/close sequence shown in FIG. 6 due to obstruction of the door close detection switch ON/OFF detection portion 18 or the lock mechanism operation/non-operation detection portion 19.

Accordingly, due to the improvement in the door open/close sequence shown in FIG. 2, shifting of the door to the operation of "Full Close" in Status (S1) can be continued by the operation of "ReClose" in Status (S6) even in the case where, for example, a signal (Dcsm=OFF) indicating OFF detected by the door close detection switch ON/OFF detection portion 18 is obtained due to the occurrence of obstruction of the door close detection switch ON/OFF detection portion 18 after the operation of "Full Close" in Status (S1) has been detected. Thus, an unexpected door open state can be prevented from occurring due to the operation of "Recycle Open & Close" in Status (S5) in the background-art door open/close sequence shown in FIG. 6.

Embodiment 2

According to the aforementioned Embodiment 1, it is possible to improve the situation of occurrence of such an extremely unexpected operation that Event (E4b) "Dcsm=OFF" falls into Event (E5a) "Obstruction Detected" in the background-art door open/close sequence shown in FIG. 6 due to obstruction of the door close detection switch ON/OFF detection portion 18. However, when obstruction occurs in the door close detection switch ON/OFF detection portion 18 and/or obstruction occurs in the lock mechanism operation/non-operation detection portion 19, the state of the operation of "Full Close" in Status (S1) cannot be kept. Therefore, the door is opened once to obtain Event (E6a) "Dcsm=OFF", and then an operation to close the door by the operation of "ReClose" in Status (S6) is performed continuously to obtain Event (E6b) "Dcsm=ON" to thereby lead to the state of the operation of "Full Close" in Status (S1) again. This open and close operation is recycled. Thus, there occurs a quick door open and close recycle phenomenon in which the door is opened due to obstruction of the lock mechanism and further the opened door is closed by the operation of "ReClose" in Status (S6). Incidentally, the quick door open and close recycle phenomenon somewhat varies due to the total weight of the door apparatus etc., but is recycled several times per second on average.

Even in the case where the quick door open and close recycle phenomenon occurs in this manner, the door is kept in a state close to "Full Close" in Status (S1). Accordingly, there is no special obstacle on the safety. Under normal circumstances, however, in view of the safety of the entire train operating system, whether to permit running or not, including whether to depart or whether to stop urgently, is determined after Event (E6b) "Dcsm=ON" in all doors has been confirmed.

Incidentally, as to the Dcsm signal, that is, the ON/OFF of the door close detection switch during the quick door open and close recycle operation, ON/OFF is recycled quickly in the same manner as the door open/close operation under normal circumstances. The determination time of "Dcsm=OFF" for determining whether the door is open or not during running depends on the entire train operating system, but is often set to be as long as about two seconds in consideration of false detection. Also taking into consideration the fact that the Dcsm signal is made OFF only for a short time (not longer than one second) during the aforementioned recycle operation, opening of the door cannot be detected during running under the setting. When the obstruction of the lock mechanism operation/non-operation detection 19 cannot be detected, there is a risk that the train may keep on running as it is in spite of the obstruction.

Accordingly, a door control device according to Embodiment 2 of the invention is designed to further enhance the safety in order to prevent such a quick door open and close recycle operation from occurring.

Figure 3:
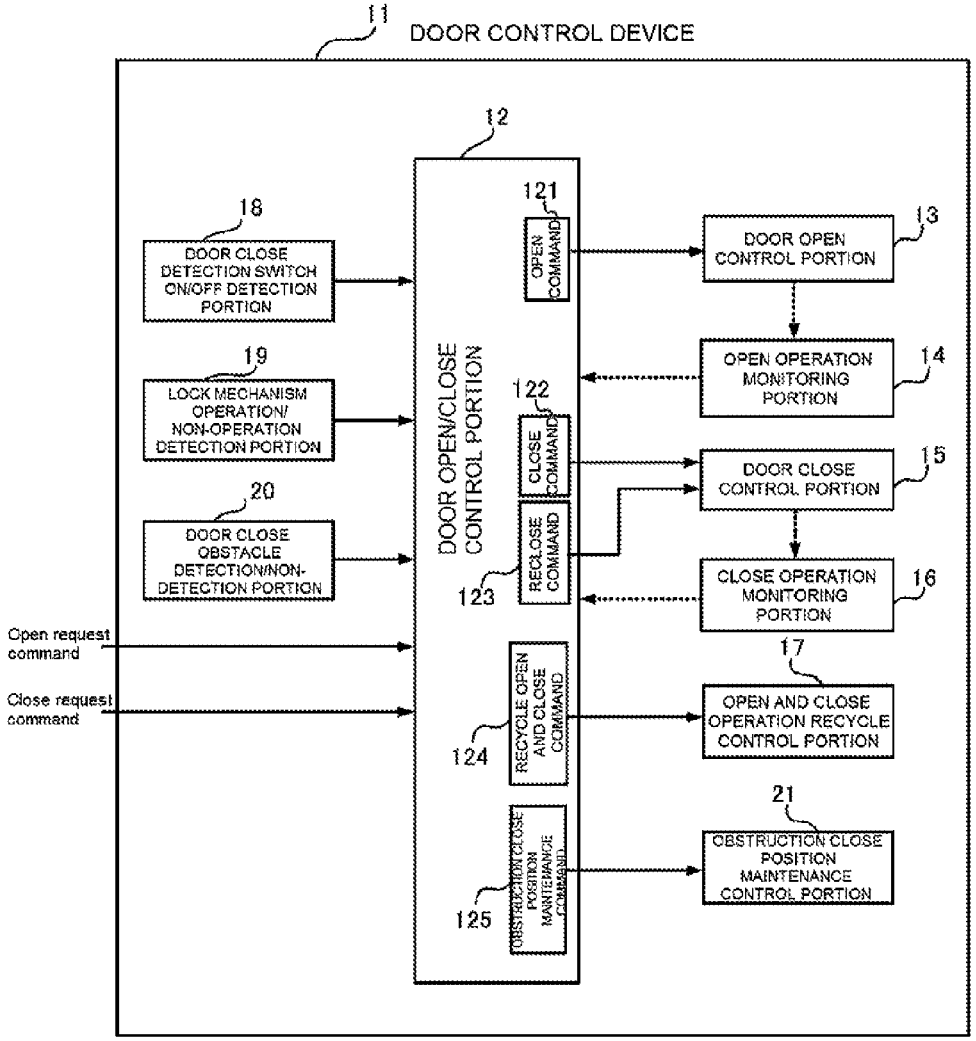
FIG. 3 is a block diagram showing the configuration of a door control device according to Embodiment 2 of the invention.

FIG. 3 is a block diagram showing the configuration of the door control device according to Embodiment 2 of the invention. The door control device shown in FIG. 3 is applied to the train door apparatus shown in FIGS. 5A and 5B.

In FIG. 3, the door control device 11 includes a door open/close control portion 12, a door open control portion 13, an open operation monitoring portion 14, a door close control portion 15, a close operation monitoring portion 16, an open and close operation recycle control portion 17, a door close detection switch ON/OFF detection portion 18, a lock mechanism operation/non-operation detection portion 19, a door close obstacle detection/non-detection portion 20, and an obstruction close position maintenance control portion 21.

The door open/close control portion 12 imports, as inputs to itself, signals from the aforementioned door close detection switch ON/OFF detection portion 18, the aforementioned lock mechanism operation/non-operation detection portion 19 and the aforementioned door close obstacle detection/non-detection portion 20, an open request command/close request command from a not-shown operating system and signals from the aforementioned open operation monitoring portion 14 and the aforementioned close operation monitoring portion 16. At the same time, the door open/close control portion 12 outputs, from itself, an open command to the door open control portion 13 through an open command portion 121, a close command and a reclose command to the door close control portion 15 through a close command portion 122 and a reclose command portion 123, a recycle open and close command to the open and close operation recycle control portion 17 through a recycle open and close command portion 124, and further an obstruction close position maintenance command to the obstruction close position maintenance control portion 21 through an obstruction close position maintenance command portion 125, respectively.

Figure 4:
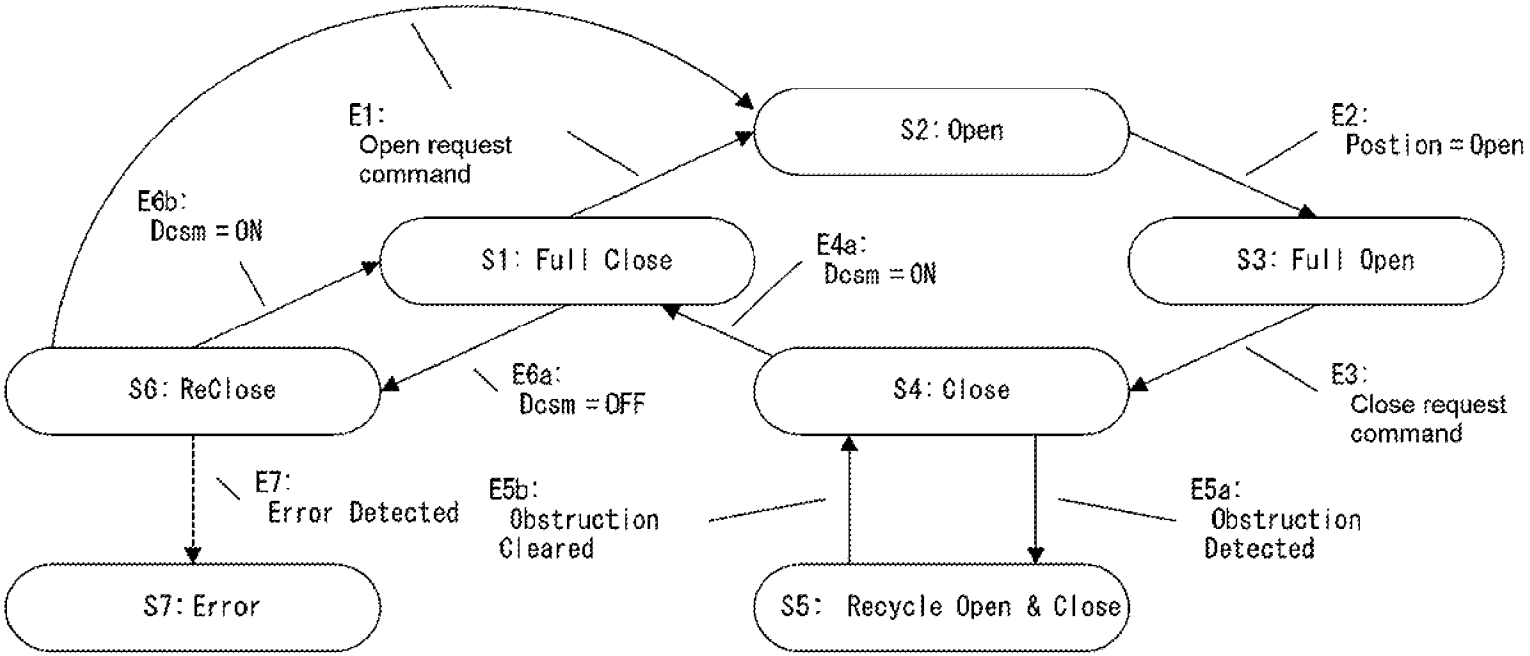
FIG. 4 is a view showing a door open/close sequence according to Embodiment 2 of the invention.

FIG. 4 is a view showing a door open/close sequence according to Embodiment 2 of the invention, in which a safer door open/close operation can be performed in spite of occurrence of a quick door open and close recycle operation in the door open/close sequence according to Embodiment 1 shown in FIG. 2. As a solution to this, the obstruction close position maintenance command portion 125 is provided in the door open/close control portion 12 in FIG. 4. In addition, the obstruction close position maintenance control portion 21 executes an obstruction close position maintenance operation in accordance with the obstruction close position maintenance command to suspend/keep (maintain) the close operation of the door at the current position so as to prevent the quick door open and close recycle operation from being continued.

In FIG. 4, an obstruction detection event expressed as Event (E7) "Error Detected" is added on the assumption that the quick door open and close recycle operation may occur in the door open/close sequence according to the aforementioned Embodiment 1. An obstruction signal is outputted due to the operation of "Error" in Status (S7) and the door is maintained at the close position when the obstruction is detected. Thus, the aforementioned quick door and close recycle operation can be stopped so that the operating system can detect the "Dcsm=OFF" state based on Event (E6a) "Dcsm=OFF". Accordingly, the operating system can surely detect obstruction of the lock mechanism operation/non-operation detection portion 19. Thus, an unsafe running state caused by the obstruction of the door close detection switch ON/OFF detection portion 18 or the non-operation of the lock mechanism operation/non-operation detection 19 can be avoided.

Incidentally, in the obstruction detection event expressed as Event (E7) "Error Detected", two kinds of obstruction detection methods which will be described later are effective. That is:

(Detection Method 1)

The fact that the quick door open and close recycle operation has been performed a plurality of times within a predetermined time is detected. Thus, the fact that the state of the operation of "Full Close" in Status (S1) cannot be kept due to the non-operation of the lock mechanism operation/non-operation detection portion 19 or the obstruction of the lock mechanism per se is detected. Determination is made as obstruction of the lock mechanism operation/non-operation detection portion 19 (also including obstruction of the lock mechanism 5 per se). An obstruction signal is outputted.

Specifically, the fact that the close operation of the door has been performed by the door close control portion 13 recyclically a plurality of times within a predetermined time is detected due to the recycle of ON/OFF of the door close detection switch ON/OFF detection portion 18. Thus, determination is made that the aforementioned quick door open and close recycle phenomenon has occurred. An obstruction signal of the lock mechanism operation/non-operation detection portion 19 is outputted. The door is maintained in the close position, which is the position where the obstruction was detected, by the obstruction close position maintenance control portion 21.

(Detection Method 2)

The fact that the operation of "Full Close" in Status (S1) cannot be restored even if the operation of "ReClose" in Status (S6) is continued for a predetermined time is detected. Thus, determination is made as OFF obstruction of the door close detection switch ON/OFF detection portion 18 (also including obstruction of the door close detection switches 4 per se). An obstruction signal is outputted.

Specifically, in the case where ON cannot be detected by the door close detection switch ON/OFF detection portion 18 even when the close operation of the door performed by the door close control portion 13 is continued for a predetermined time, determination is made as obstruction of the door close detection switch ON/OFF detection portion 18. An obstruction signal of the door close detection switch ON/OFF detection portion 18 is outputted. The door is maintained at the close position, which is the position where the obstruction was detected, by the obstruction close position maintenance control portion 21.

Incidentally, predetermined values may be set in advance for the predetermined time for determination and the number of recycle times within the predetermined time in the aforementioned detection method 1 or 2.

When obstruction occurs in the door close detection switch ON/OFF detection portion 18 and/or obstruction occurs in the lock mechanism operation/non-operation detection portion 19, a recycle of operations in Statuses (S1)→(S6)→(S1)→(S6) . . . is performed in the aforementioned door apparatus according to Embodiment 1 of the invention. According to the door control device according to Embodiment 2 of the invention, however, such a recycle of operations can be prevented from occurring.

It will be apparent to those skilled in the art that various modifications and variations can be made to the disclosed method and apparatus. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A door control device that opens and closes a door using a door drive portion, the door control device comprising:

a door opening and closing control portion that gives an open command to the door drive portion, a close command to the door drive portion, a reclose command to the door drive portion, and a recycle open and close command to the door drive portion, the door drive portion being driven in response to each of the close, reclose and open commands, and driven recyclically in response to the recycle open and close command;

a door close detection portion that detects a full close state of the door based on whether a switch is detected to be in an ON status or an OFF status; and wherein the door opening and closing control portion is configured so that in response to the ON status transitioning, not in response to any open command to open the door being provided to the door drive portion by the door opening and closing control portion, to the OFF status, the door opening and closing control portion performs a reclose operation of giving the reclose command to the door drive portion to control the door drive portion to perform an open operation of the door and then a continuous close operation of the door until the ON status is detected.

2. The door control device according to claim 1, further comprising:

a lock mechanism operation detection portion that detects an operation and non-operation of a lock mechanism for locking the door in a close position, wherein when the reclose operation has been performed recyclically such that the close operation of the door has been performed recyclically a plurality of times within a predetermined time, an obstruction signal of the lock mechanism is outputted by the door control device.

3. The door control device according to claim 1, wherein in the reclose operation, when the ON status of the switch is not detected by the door close detection switch portion when the close operation of the door is performed continuously for a time, an obstruction signal of the door close detection portion is outputted by the door control device.

4. The door control device according to claim 1, wherein in the reclose operation, an open command operation is validated by the door control device when the close operation of the door is continuously performed due to the OFF status of the switch being detected by the door close detection portion.

5. A door control device that opens and closes a door using a door drive portion, the door control device comprising:

a door opening and closing control portion that gives an open command to the door drive portion, a close command to the door drive portion, a reclose command to the door drive portion, and a recycle open and close command to the door drive portion, the door drive portion being driven in response to each of the close, reclose and open commands, and driven recyclically in response to the recycle open and close command;

a door close detection portion that detects a full close state of the door based on whether a switch is detected to be in an ON status or an OFF status; and a lock mechanism operation detection portion that detects an operation and non-operation of a lock mechanism for locking the door in a close position;

wherein the door opening and closing control portion is configured so that in response to the lock mechanism operation detection portion detecting the non-operation of the lock mechanism, the door opening and closing control portion performs a reclose operation of giving the reclose command to the door drive portion to control the door drive portion to perform an open operation of the door and then a continuous close operation of the door until the ON status is detected.

6. The door control device according to claim 5, wherein an open command operation is validated by the door control device when in the reclose operation, the close operation of the door is continuously performed for a predetermined time due to the non-operation of the lock mechanism being detected by the lock mechanism operation detection portion.

7. The door control device according to claim 5, wherein when the reclose operation has been performed recyclically such that the close operation of the door has been performed recyclically a plurality of times within a predetermined time, an obstruction signal of the lock mechanism is outputted by the door control device.

8. The door control device according to claim 5, wherein in the reclose operation, the door opening and closing control portion controls the door drive portion to perform the open operation regardless of whether an ON status is detected.

9. The door control device according to claim 8, wherein the ON status is detected when the open operation of the reclose operation is initiated by the door opening and closing control portion.

10. The door control device according to claim 5, wherein the door opening and closing control portion controls the door drive portion to continuously perform the reclose operation until both the ON status is detected and the operation of the lock mechanism is detected.

* * * * *